United States Patent [19]

Gruenwald

[11] Patent Number: 4,556,245

[45] Date of Patent: Dec. 3, 1985

[54] CARRYING HANDLE ASSEMBLY FOR A DIVING TANK

[75] Inventor: Mark J. Gruenwald, Germantown, Wis.

[73] Assignee: Clearwater Technologies Inc., Menomonee Falls, Wis.

[21] Appl. No.: 664,372

[22] Filed: Oct. 24, 1984

[51] Int. Cl.[4] ..... B65D 25/28; B65D 63/18

[52] U.S. Cl. ..... 294/31.2; 294/154; 294/170; 16/110 R; 16/116 R

[58] Field of Search ..... 294/31.2, 137, 148–151, 294/153–157, 165, 170; 16/110 R, 114 R, 116 R, 119, 124–126

[56] References Cited

U.S. PATENT DOCUMENTS

| | | | |
|---|---|---|---|
| 2,973,989 | 3/1961 | Harwood | 294/31.2 |
| 2,981,562 | 4/1961 | Long | 294/31.2 |
| 2,997,218 | 8/1961 | Kobles | 294/150 |
| 3,243,020 | 3/1966 | Friedlander | 16/110 R |
| 3,488,078 | 1/1970 | Cooperstein | 294/31.2 |
| 4,458,933 | 7/1984 | Thomas | 294/31.2 |

*Primary Examiner*—Johnny D. Cherry

*Attorney, Agent, or Firm*—Andrus, Sceales, Starke & Sawall

[57] ABSTRACT

A carrying handle assembly for a diving tank including a pair of straps that encircle the tank. A handle extends longitudinally of the tank and is removably connected to the straps. The handle comprises a rigid tubular core having a dog-leg shape, with the rear portion of the core extending at an angle of about 30° with respect to the forward portion. Bonded to the outer surface of the core is a resilient foam plastic covering and a flexible strap is inserted through the central opening in the core and the ends of the strap are removably attached to the straps that encircle the tank. In use, the operator grasps the forward portion of the handle which is held generally horizontally and the tank will be inclined upwardly and forwardly at an angle of about 30°.

5 Claims, 4 Drawing Figures

CARRYING HANDLE ASSEMBLY FOR A DIVING TANK

BACKGROUND OF THE INVENTION

Because of the size and weight, divers' tanks are awkward to carry, particularly when the diver is required to traverse steps, inclines or other irregular terrain. Attempts have been made in the past to facilitate carrying of the diver's tank by utilizing shoulder harnesses. However, with the use of a shoulder harness the tank has a tendency to swing and in some cases the harness may slip relative to the tank.

Carrying handles have not been successfully used with diver's tanks because the heavy weight of the tank had a tendency to squeeze the diver's fingers gripping the handle. In addition, with carrying handles as used in the past, the tank was normally carried in a horizontal attitude and, as such, the valve on the forward end of the tank could catch on steps or other obstructions during transporting.

SUMMARY OF THE INVENTION

The invention is directed to an improved carrying handle assembly for a diver's tank. In accordance with the invention, the carrying handle assembly includes a pair of straps which encircle the tank and are spaced longitudinally along the length of the tank. A handle that extends longitudinally of the tank is removably connected to the straps.

The handle includes a rigid tubular core having a dog-leg shaped configuration, with a rear section of the core being disposed at an angle of about 25° to 30° with respect to the front section. Bonded to the outer surface of the core is a resillient covering of foam plastic material.

A short length of strap is freely disposed within the central opening in the handle and the ends of the strap are connected by quick release connectors to the straps that encircle the tank.

In use, the operator will grasp the forward section of the handle which will be held generally horizontal by the operator. Due to the configuration of the handle, the tank will be positioned at an angle of about 25° to 35° with respect to the horizontal. This angular attitude of the tank insures that the tank valve will be substantial distance above the ground during carrying, so that it is not in a position to catch on steps or other obstructions.

Due to the construction of the handle, including the rigid core and the outer resilient foam covering, the tank is comfortable to carry and the handle will not collapse, nor squeeze the fingers during carrying.

As the handle is freely movable on the strap, the position of the handle can be readily adjusted longitudinally of the tank, depending on the location of the tank straps, to ensure that the tank is in the desired inclined attitude during carrying.

The tank straps are provided with an inner coating of neoprene rubber which will ensure a positive grip on the smooth tank surface and prevent shifting of the tank straps during use.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
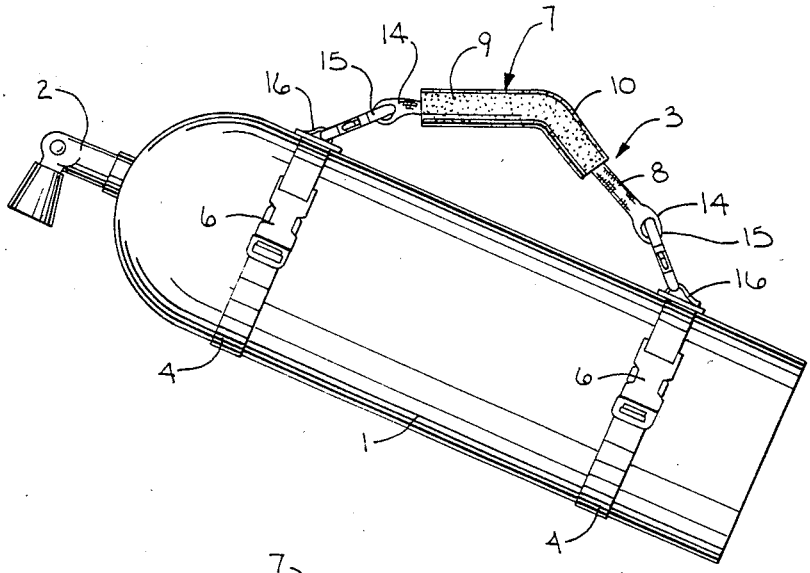
FIG. 1 is a side elevation of a diving tank incorporating the carrying handle assembly of the invention.

FIG. 1 illustrates a generally cylindrical diving tank 1 having a valve assembly 2 at one end. In accordance with the invention, a carrying handle assembly, indicated generally by 3, is attached to tank 1 to facilitate carrying of the tank.

Figure 4:
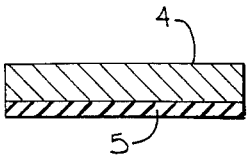
FIG. 4 is a transverse section of one of the tank straps.

The carrying assembly 3 includes a pair of fabric tank straps 4 which are formed of a fabric, such as nylon, and encircle the tank. Straps 4, as shown in FIG. 4, are provided with an inner layer of neoprene rubber 5 having a high coefficient of friction which prevents slippage of the straps 4 relative to tank 2. Each strap can be connected around the tank by a conventional quick release connector 6.

The carrying assembly 3 also includes a handle 7 and a strap 8 which is freely slidable within handle 7 and is connected to the tank straps 4.

Handle 7 has a dog-leg shape consisting of a forward section 9 and a rear section 10 that is at an angle of about 25° to 35°, with respect to the forward section. Forward section 9 has a longer length than rear section 10 and is adapted to be gripped by the operator when carrying the tank.

Figure 3:
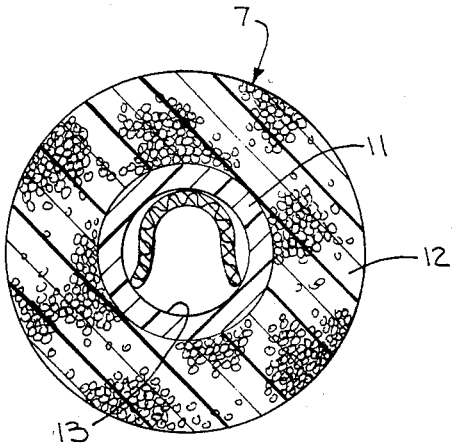
FIG. 3 is a section taken along line 3—3 of FIG. 2.
Figure 2:
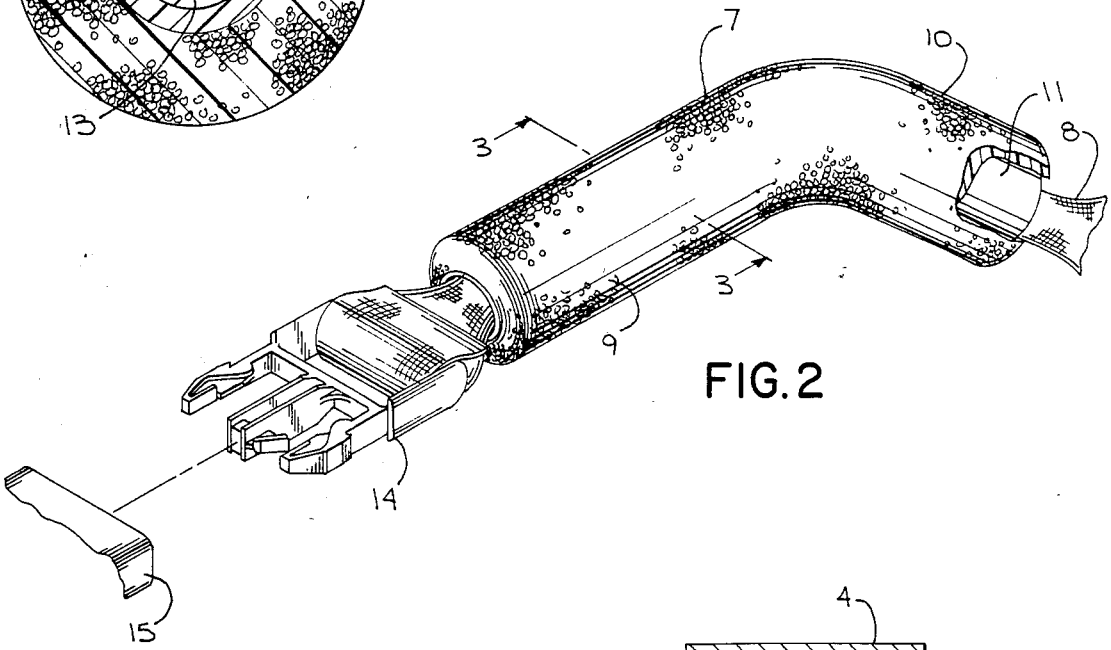
FIG 2 is a perspective view of the handle.

Handle 7 is composed of a tubular rigid core 11, preferably formed of a plastic material, such as polyvinylchloride, and bonded to the outer surface of core 11 is a layer 12 or resilient material, such as polyurethane foam, or the like. Strap 8 is flexible and extends freely through the central opening 13 in core 9. As shown in FIG. 3, the portion of strap 8 disposed within opening 13 is folded over in a generally U-shaped configuration.

The ends of strap 8 carry male quick release connectors 14 which are adapted to be engaged with female quick release connectors 15, mounted through adaptors 16 to the tank straps 4.

In use, the operator will grip the forward portion 9 of handle 7, so that this portion will be held generally horizontally. Due to the configuration of the handle, the tank will thus be maintained at an upwardly inclined attitude, as shown in FIG. 1, of about 25° to 35°. This inclined position lifts the valve 2 a substantial distance above the ground and aids in preventing the valve from catching on steps or obstructions when the tank is being carried.

As a further advantage, the inclined attitude of the tank is continually maintained during carrying. On the other hand, if the tank is carried in a horizontal attitude, it will tend to tip forwardly or rearwardly so that the operator is continually fighting to maintain the tank in a horizontal position.

The tank handle, having a rigid core and an outer resilient layer of foam material, is comfortable to carry and will not collapse or squeeze the fingers of the operator when being carried.

As all of the parts of the carrying assembly are fabricated from fabric or plastic materials, the assembly is non-corrosive and the tank straps 4 can remain with the tank during the dive, if desired.

It is also contemplated that a shoulder strap can replace the handle 7 and be connected to the tank straps 4 in a similar manner.

Various modes of carrying out the invention are contemplated as being within the scope of the following claims particulary pointing out and distinctly claiming the subject matter which is regarded as the invention.

I claim:

1. In combination a diving tank, a carrying handle assembly attached to the tank, said carrying handle assembly comprising a pair of tank straps encircling the tank and spaced longitudinally of the tank, a handle extending longitudinally of the tank and comprising a rigid tubular core having a central opening, said core including a first section and a second section disposed longitudinally of said first section and positioned at an angle of about 25° to 35° with respect to said first section, said handle also including a resilient layer secured to the outer surface of said core, a flexible member freely disposed within the central opening in said core, and means for removably connecting each end of the flexible member to the respective tank straps.

2. The combination of claim 1, wherein said core is formed of a rigid plastic material and said resilient layer is a foam plastic material.

3. The combination of claim 1, wherein said flexible member comprises a handle strap having a substantially greater width than thickness, the portion of said strap disposed within the opening in said core being folded to a generally U-shape.

4. The combination of claim 1, wherein said second section of the core extends at an angle of about 30° with respect to said first section.

5. In combination, a generally cylindrical diving tank, a pair of tank straps encircling the tank and spaced longitudinally of the tank, a handle extending longitudinally of the tank, said handle having a dog-leg shape including a first section to be gripped by an operator and a second section disposed longitudinally of the first section and disposed at an angle of about 25° to 30° with respect to said first section, said handle comprising a rigid tubular core and an outer covering of resilient material, said core having a central passage therein, a handle strap freely disposed within said central passage whereby said handle can be moved longitudinally relative to said handle strap and means for removably connecting each end of said handle strap to the respective tank strap.

* * * * *

UNITED STATES PATENT AND TRADEMARK OFFICE

CERTIFICATE OF CORRECTION

PATENT NO. : 4,556,245

DATED : December 3, 1985

INVENTOR(S) : MARK A. GRUENWALD

It is certified that error appears in the above-identified patent and that said Letters Patent is hereby corrected as shown below:

Col. 2, Line 30, After "35°" insert ---and preferably 30°---'

Col. 2, Line 36, Cancel "or" and substitute therefor ---of---

Signed and Sealed this

*Thirteenth* Day of *May 1986*

[SEAL]

*Attest:*

DONALD J. QUIGG

*Attesting Officer*

*Commissioner of Patents and Trademarks*